US006890214B2

(12) United States Patent
Brown et al.

(10) Patent No.: US 6,890,214 B2
(45) Date of Patent: May 10, 2005

(54) MULTI-SEQUENCED CONTACTS FROM SINGLE LEAD FRAME

(75) Inventors: John B. Brown, Dillsburg, PA (US); Steven A. Weller, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 92 days.

(21) Appl. No.: 10/224,942

(22) Filed: Aug. 21, 2002

(65) Prior Publication Data

US 2004/0043660 A1 Mar. 4, 2004

(51) Int. Cl.[7] ..... H01R 13/648
(52) U.S. Cl. ..... 439/608
(58) Field of Search ..... 439/608, 680, 439/79, 78, 681, 676, 941, 80, 607

(56) References Cited

U.S. PATENT DOCUMENTS

| | | | | |
|---|---|---|---|---|
| 3,766,513 A | | 10/1973 | Carre | |
| 4,405,189 A | | 9/1983 | Douty et al. | |
| 4,867,690 A | * | 9/1989 | Thumma | 439/79 |
| 5,582,519 A | | 12/1996 | Buchter | 439/101 |
| 5,586,915 A | | 12/1996 | Baker et al. | 439/733.1 |
| 5,591,035 A | | 1/1997 | Burkholder et al. | 439/79 |
| 5,667,392 A | | 9/1997 | Kocher et al. | 439/79 |
| 5,733,148 A | * | 3/1998 | Kaplan et al. | 439/680 |
| 6,089,877 A | | 7/2000 | Seidel | 439/79 |
| 6,123,555 A | | 9/2000 | Chiu | 439/79 |
| 6,371,773 B1 | * | 4/2002 | Crofoot et al. | 439/79 |
| 6,517,386 B2 | * | 2/2003 | Sakakura et al. | 439/676 |

FOREIGN PATENT DOCUMENTS

| | | | |
|---|---|---|---|
| EP | 0 521 648 A2 | 1/1993 | H01R/13/648 |
| EP | 0 717 468 A2 | 6/1996 | H01R/13/648 |

* cited by examiner

*Primary Examiner*—J. F. Duverne

(57) ABSTRACT

An electrical connector assembly comprising a housing having an interior chamber defining at least one lead frame plane, and identical sets of non-identical lead frame elements. The lead frame plane has a reference point. The lead frame elements are mounted in the interior chamber and aligned within at least one lead frame plane. The lead frame elements are adjustable along the lead frame plane between multiple levels with respect to the reference point. The multiple mating levels of the lead frame elements are created from only one lead frame. The mating levels are selected by the individual lead frame elements being positioned with respect to the reference point. The electrical connector also comprises N lead frame elements, each of which is adjustable between M mating levels to form X lead frame configurations, wherein $X=M^N$.

18 Claims, 12 Drawing Sheets

MULTI-SEQUENCED CONTACTS FROM SINGLE LEAD FRAME

BACKGROUND OF THE INVENTION

Certain embodiments of the present invention generally relate to improvements in electrical connectors and more particularly relate to multi-sequenced electrical connectors that include lead frames.

Various electronic systems, such as computers, comprise a wide array of components mounted on printed circuit boards, such as daughtercards and motherboards, which are interconnected to transfer signals and power throughout the systems. The circuit boards are joined through electrical connectors. Typical connector assemblies include a plug connector and a receptacle connector, each of which may house a plurality of electrical contacts or wafers. An electrical wafer may be a thin printed circuit board or a series of laminated contacts within a plastic carrier. The electrical wafers within one connector may allow a daughter card to communicate with another daughter card through a backplane. Alternatively, the wafers may be mated in an orthogonal orientation obviating the need for a backplane.

Typically, electrical traces are etched onto the electrical wafers. The electrical traces permit high-speed transmission of data signals. However, when it comes to carrying power, distinct power blade contacts are utilized within a connector. Power blade contacts are often configured as lead frames. The lead frames typically include a plurality of contact points. For various reasons, the contact points of the lead frames may be sequenced such that one or more contact points in one assembly of the connector, such as a plug assembly, interface with corresponding contact points in the other assembly of the connector, such as a receptacle assembly, before other points of contact. For example, typically it is desirable to have ground contacts contact each other before signal contacts.

Electrical connectors have been proposed with sequenced lead frames, that is, lead frames with different mating levels of contacts. For example, one contact point may be at a first mating level or depth within the connector, while other contact points may be at different mating levels. Typically, each different lead frame sequence is manufactured separately. Therefore, if a lead frame having three mating levels of contacts is used within a connector, a total of twenty-seven different lead frame sequences are possible. Consequently, twenty-seven different lead frames typically must be stamped, blanked or otherwise formed and inventoried to accommodate the total number of lead frame possibilities. Additionally, twenty-seven lead frames require additional stamping, die tooling and set-ups, resulting in a higher cost of production.

Thus, a need exists for a more efficient system and method of manufacturing lead frames of varying contact sequences. Additionally, a need exists for an efficient, interchangeable lead frame configured for use within an electrical connector. Further, a need exists for a flexible lead frame design configured to create multiple mating levels for an electrical connector from a single or reduced number of lead frames.

BRIEF SUMMARY OF THE INVENTION

Certain embodiments of the present invention provide an electrical connector system comprising a plug assembly and a receptacle assembly. At least one of the plug and receptacle assemblies comprises an interior cavity defining a lead frame plane; and first and second lead frame elements located in the lead frame plane. At least one of the first and second lead frame elements are positioned at one of a plurality of mating levels along a mating direction of the at least one assembly.

The plurality of mating levels define different distances between a contact portion of the lead frame elements and a reference point of said plug or receptacle assembly. The lead frame elements are adjustable between shallow, intermediate and deep mating levels with respect to a mating face of either the plug or receptacle assembly. Overall, if there are N lead frame elements, each of which is adjustable between M levels to form X lead frame element configurations, the equation $X=M^N$ defines the number of lead frame configurations, combination, sequences, etc., that are possible.

Figure 1:
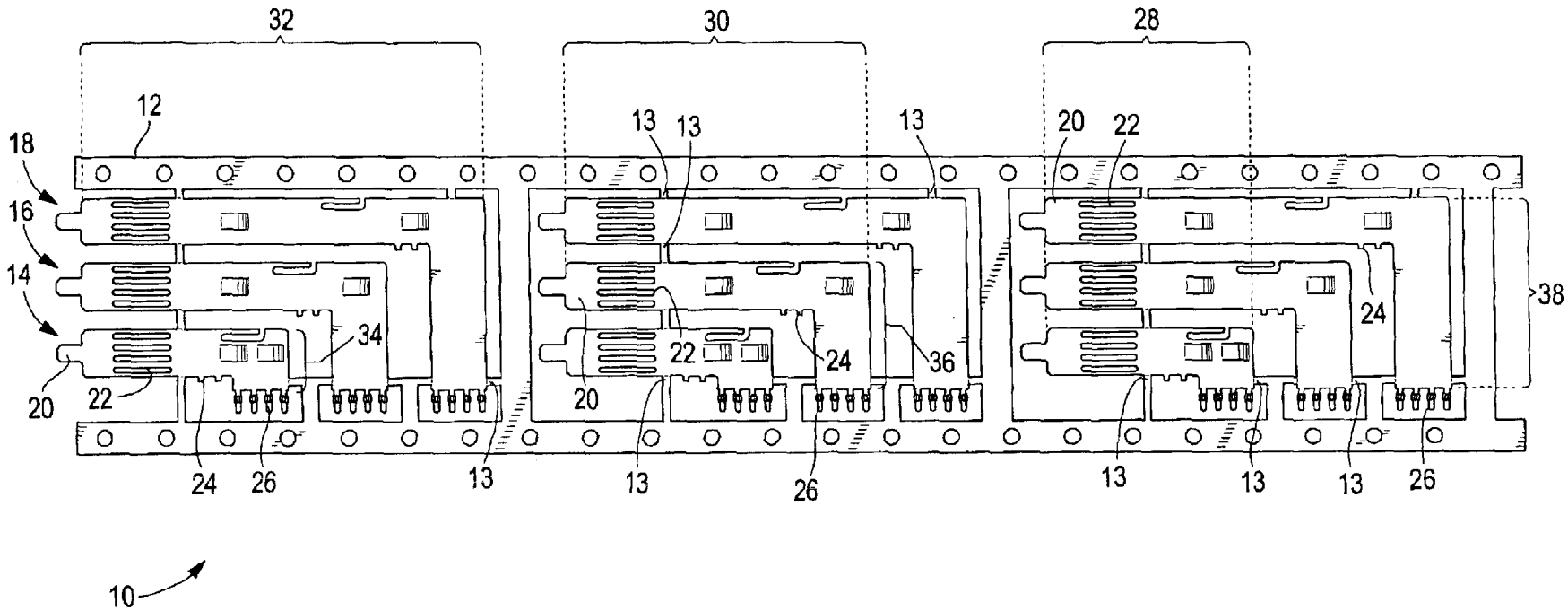
FIG. 1 illustrates a lead frame carrier strip attached to multiple plug lead frame elements formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a lead frame strip 10 attached to multiple plug lead frame elements 14, 16 and 18, formed in accordance with an embodiment of the present invention. A set of plug lead frame elements includes the plug lead frame elements 14, 16 and 18. During the stamping or manufacturing process, the plug lead frame elements 14, 16 and 18 are formed integrally with a carrier strip 12 of the lead frame strip 10. Identical sets of plug lead frame elements 14, 16 and 18 are formed. The lead frame strip 10 includes the carrier strip 12 connected to plug lead frame elements 14, 16, and 18, respectively, at breaking points 13. The breaking points 13 may be perforated, or otherwise weakened, to facilitate removal of the plug lead frame elements 14, 16 and 18 from the carrier strip 12.

The plug lead frame element 14 includes an extension portion 28 formed integrally with, and connecting at a right angle to, a board transition portion 34. The plug lead frame element 16 includes an extension portion 30 formed integrally with, and connecting at a right angle to, a board transition portion 36. The lead frame element 18 includes an extension portion 32 formed integrally with, and connecting at a right angle to, a board transition portion 38. Alternatively, the extension portions 28, 30 and 32 may connect to the board transition portions 34, 36 and 38, respectively, at angles other than right angles. As shown in FIG. 1, the length of the extension portion 28 is shorter than that of the extension portion 30, which in turn is shorter than that of the extension portion 32. Similarly, the height of the board transition portion 34 is shorter than that of the board transition portion 36, which in turn is shorter than that of the board transition portion 38.

Each of the plug lead frame elements 14, 16 and 18 include a contact portion 20 extending outwardly from each respective extension portion 28, 30 and 32. Additionally, each of the plug lead frame elements 14, 16 and 18 may include flex slots 22, which may provide added flexibility for the lead frame elements 14, 16 and 18. Pins 26, which may be received by receptacles, such as through-holes, in a printed circuit board (not shown), extend downwardly from the board transition portions 34, 36 and 38. Also, each plug lead frame element 14, 16 and 18 may include positioning tabs 24, which may be used to position the plug lead frame elements 14, 16 and 18 within a plug housing (as discussed below). The positioning tabs 24 may be removed depending on the desired level (discussed below) of the plug lead frame elements 14, 16 and 18 within a plug connector. Alternatively, the plug lead frame elements 14, 16 and 18 may include more or less than two positioning tabs 24. Also, alternatively, the plug lead frame elements 14, 16 and 18 may not include positioning tabs 24. Additionally, the plug lead frame elements 14, 16 and 18 may not include flex slots 22.

Before the plug lead frame elements 14, 16 and 18 are inserted, or positioned, within a plug housing, the plug lead frame elements 14, 16 and 18 are removed from the supporting body 12 of the carrier strip 10.

Figure 2:
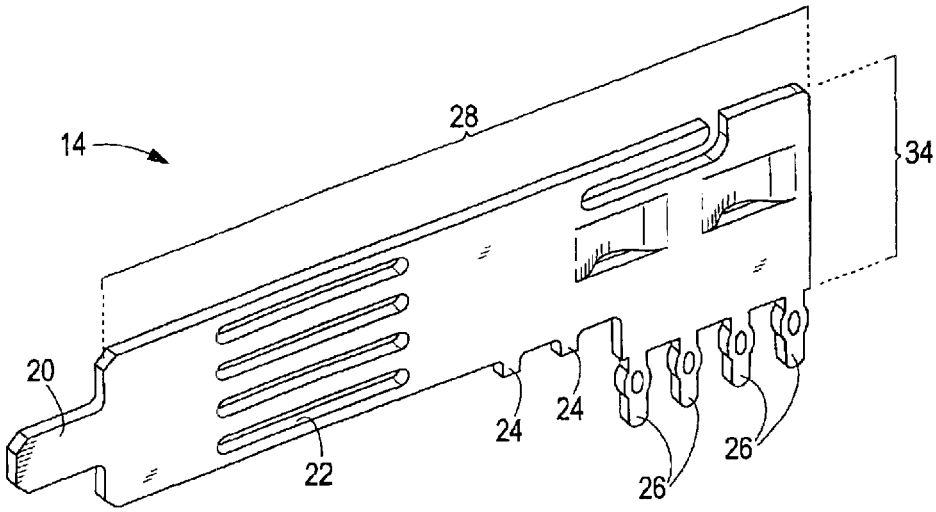
FIG. 2 is an isometric view of a plug lead frame element formed in accordance with an embodiment of the present invention.

FIG. 2 is an isometric view of a plug lead frame element 14 formed in accordance with an embodiment of the present invention.

Figure 3:
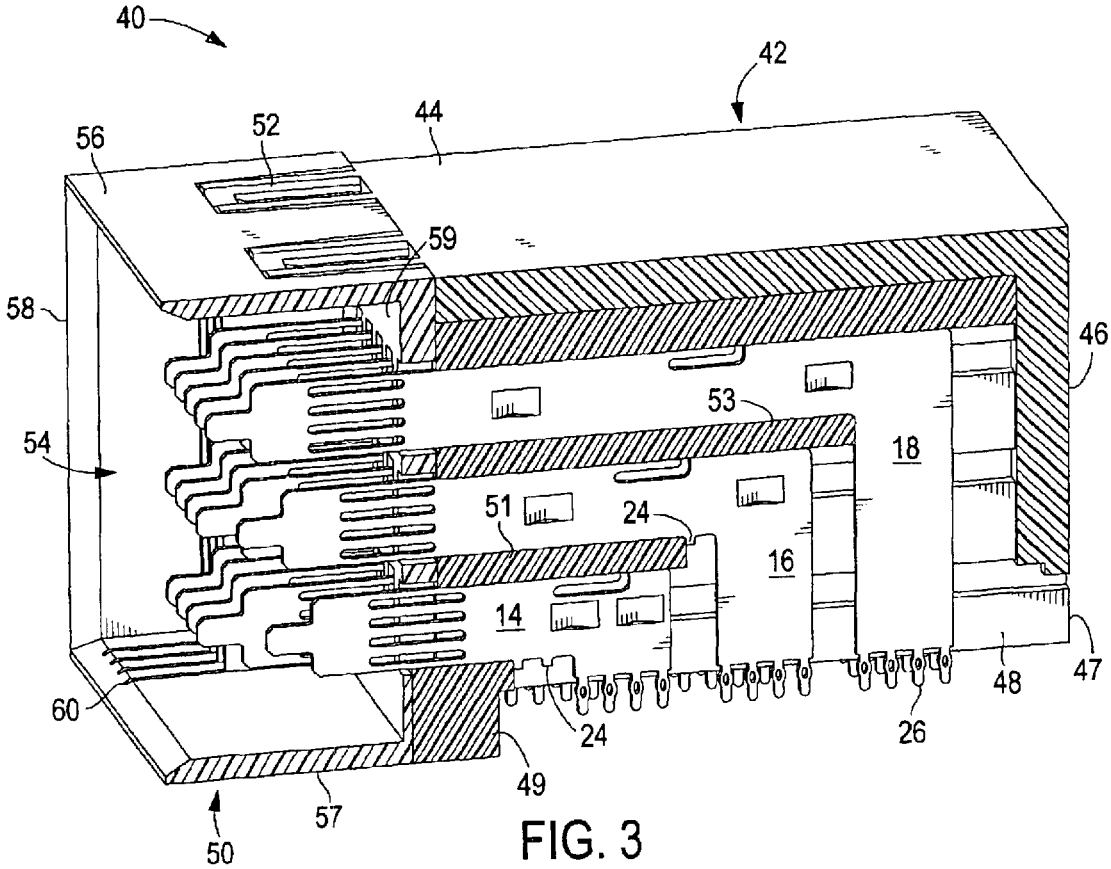
FIG. 3 is an isometric cross sectional view of a plug assembly formed in accordance with an embodiment of the present invention.
Figure 4:
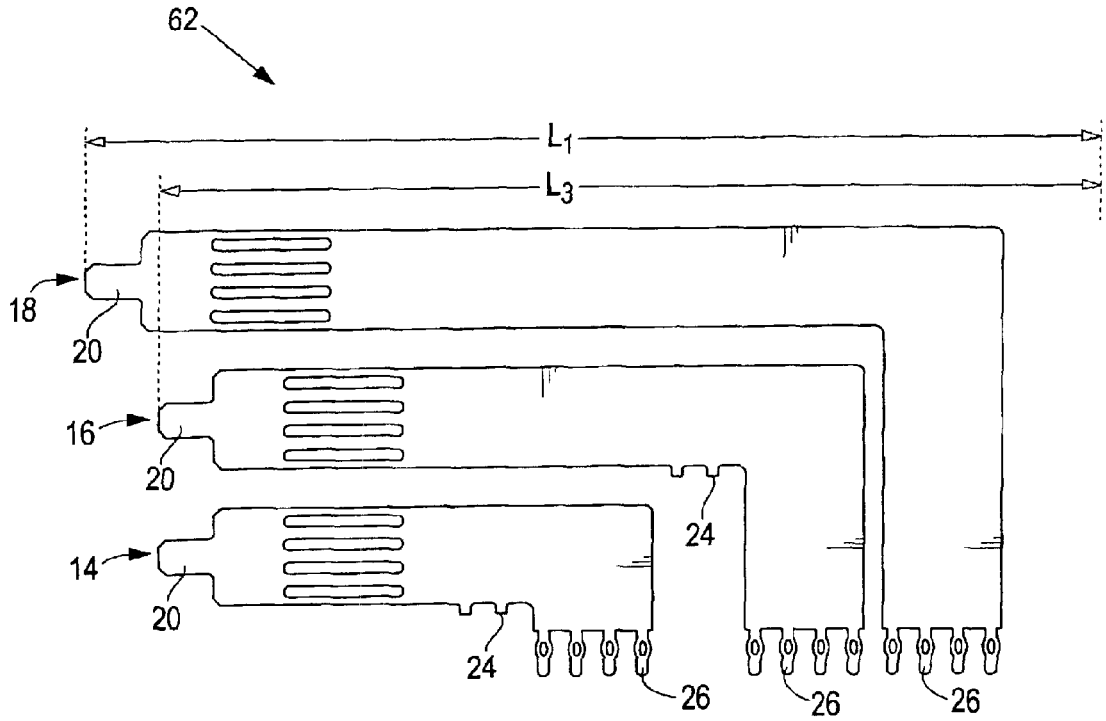
FIG. 4 illustrates an exemplary plug lead frame sequence according to an embodiment of the present invention.
Figure 5:
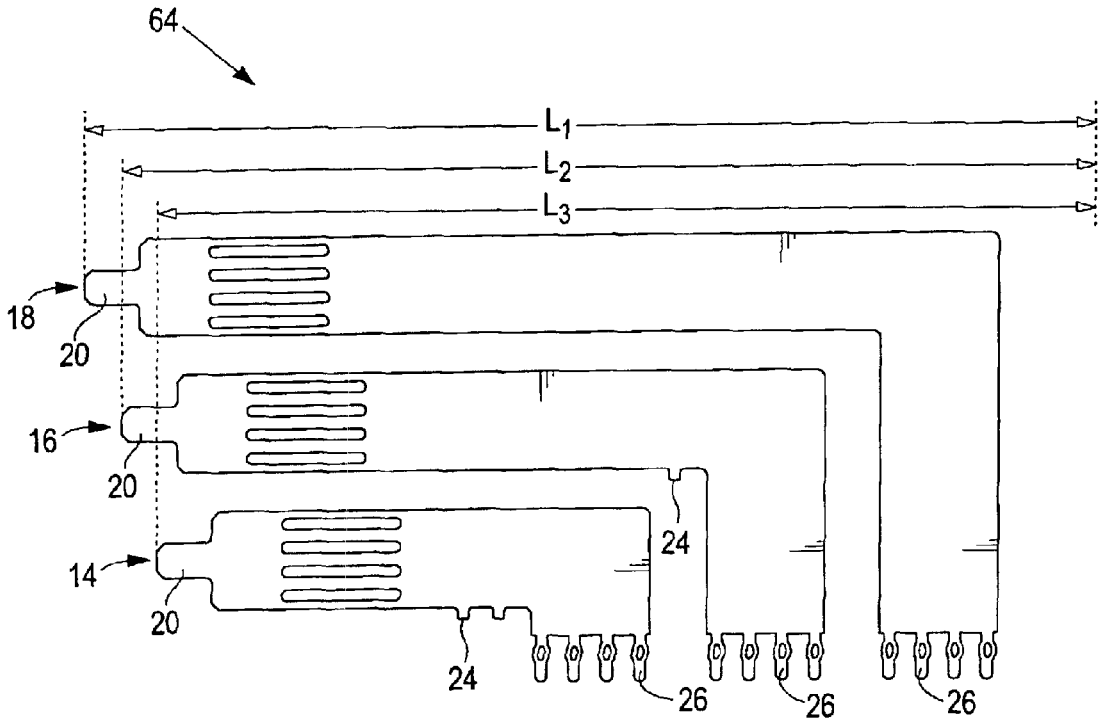
FIG. 5 illustrates an exemplary plug lead frame sequence according to an embodiment of the present invention.
Figure 6:
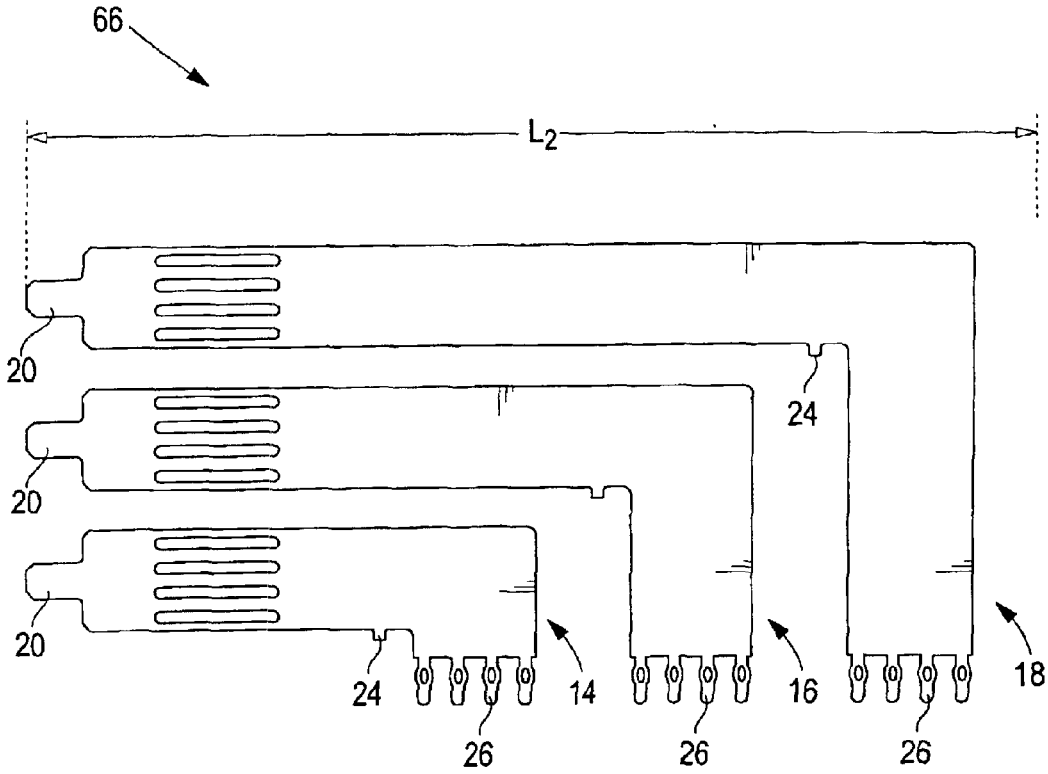
FIG. 6 illustrates an exemplary plug lead frame sequence according to an embodiment of the present invention.
Figure 7:
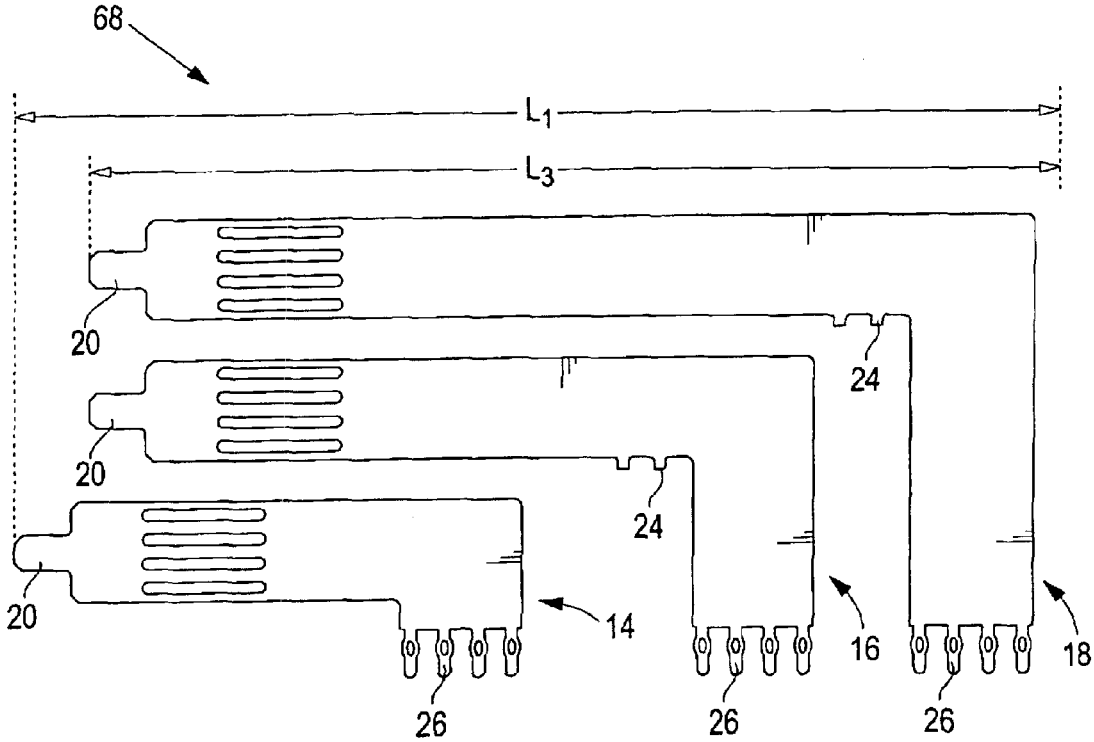
FIG. 7 illustrates an exemplary plug lead frame sequence according to an embodiment of the present invention.

FIG. 3 is an isometric cross sectional view of a plug assembly 40 formed in accordance with an embodiment of the present invention. The plug assembly 40 includes a cover 42, a lead frame organizer 47 having a plurality of organizer walls 48, which define channels therebetween, spacers 49, 51 and 53, and an interface housing 50. The cover 42 includes walls 44 and 46. The cover 42 may also include lateral walls (not shown). Alternatively, lateral walls may be formed integrally with, and extending upwardly from, the organizer 47. The interface housing 50 includes latch features 52 that engage latch members formed within the cover 42. The interface housing 50 also includes a top wall 56, a bottom wall 57, a back wall 59 and side walls 58 (only one side wall shown) that define an interface cavity 54, in which a set of plug lead frame elements, including the plug lead frame elements 14, 16 and 18, and plug circuit boards (not shown) mate with corresponding set of receptacle lead frame elements (discussed below) and receptacle circuit boards (not shown), respectively. Also, the interface housing 50 may include guide slots 60 that receive and retain edges of electrical wafers.

FIG. 3 shows a plug assembly 40 that houses both electrical wafers and plug lead frame elements. Optionally, sets of plug lead frame elements, including the plug lead frame elements 14, 16 and 18, may be housed within a separate lead frame housing (discussed below). The plug assembly 40 shown in FIG. 3 is a floating interface assembly. Floating interface connectors are described in U.S. patent application Ser. No. 10/042,635, entitled, "Floating Interface for Electrical Connector," which is incorporated herein by reference in its entirety. Alternatively, however, the plug assembly 40 may be a conventional, non-floating interface assembly.

The spacer 49 may be formed integrally with the organizer 48, lateral walls of the plug assembly 40, or the interface housing 50. The spacer 49 extends across the plug assembly 40 perpendicular to the orientation of the plug lead frame element 14. The spacer 49 may extend from one lateral wall of the plug assembly 40 to the other lateral wall of the plug assembly 40. Alternatively, the spacer 49 may extend from one lateral wall of the plug assembly 40 to a dividing wall within the plug assembly 40. Also, alternatively, the spacer 49 may extend from one dividing wall within the plug assembly 40 to another dividing wall. Also, the spacers 49, 51 and 53 may be included within a separate plug lead frame housing (as discussed below).

The spacer 51 may be formed integrally with the interface housing 50 or lateral walls of the plug assembly 40. The spacer 51 extends across the plug assembly 40 perpendicular to the orientation of the lead frame element 16. The spacer 51 may extend from one lateral wall of the plug assembly 40 to the other lateral wall of the plug assembly 40. Alternatively, the spacer 51 may extend from one lateral wall of the plug assembly 40 to a dividing wall within the plug assembly 40. Also, alternatively, the spacer 51 may extend from one dividing wall within the plug assembly 40 to another dividing wall.

The spacer 53 may be formed integrally with the interface housing 50 or lateral walls of the plug assembly 40. The spacer 53 extends across the plug assembly 40 perpendicular to the orientation of the lead frame element 18. The spacer 53 may extend from one lateral wall of the plug assembly 40 to the other lateral wall of the plug assembly 40. Alternatively, the spacer 53 may extend from one lateral wall of the plug assembly 40 to a dividing wall within the housing. Also, alternatively, the spacer 53 may extend from one dividing wall within the plug assembly 40 to another dividing wall.

As shown in FIG. 3, the spacer 49 is positioned below the spacer 51, which in turn is positioned below the spacer 53.

The spacer 49 contacts the plug lead frame element 14. The spacer 51 is positioned to allow for proper clearance of the plug lead frame element 14. Likewise, the spacer 53 is positioned to allow for proper clearance of the lead frame element 16 between the spacer 51 and the spacer 53. The spacer 51 contacts the lead frame element 16. The spacer 53 contacts the lead frame element 18.

Each plug lead frame element 14, 16 and 18 is positioned within the plug assembly 40 such that the pins 26 extend downwardly from the plug assembly 40. Bach pin 26 is received and retained by a pin receptacle (not shown) located on a printed circuit 4 board. Each printed circuit board includes a plurality of pin rectacles aligned in rows. One row of pin receptacles is aligned to receive a row of pins 26 of a longitudinally aligned set of plus lead frame elements 14, 16 and 18. Each row of pin receptacles may include more receptacles than the number of pins 26 of the longitudinally aligned set of plug lead frame elements 14, 16 and 18. For example, a printed circuit board may include rows of 15–20 pin receptacles (if for example, each plug lead frame 14, 16 and 18 includes four pins 26, respectively). Thus, the plug lead frame elements 14, 16 and 18 may be installed at different depths, or mating levels, along a mating direction of the assembly. That is, a set of three non-identical plug lead frame elements 14, 16 and 18 may be sequenced to accommodate different contact mating level configurations.

As mentioned above, the plug lead frame elements 14, 16 and 18 may include positioning tabs 24, which may assist in proper positioning of the plug lead frame elements 14, 16 and 18. The plug lead frame elements 14, 16 and 18 are retained within the plug assembly 40 by retaining features, channels, and the like. The positioning tabs 24 of the plug lead frame elements 14, 16 and 18 (or the plug lead frame elements 14, 16 or 18 themselves) abut against the spacers 49, 51 and 53, respectively. If, for example, a plug lead frame element 14, 16 or 18 is to be positioned such that it extends at the furthest possible length ("first mating level") from a reference point within the plug assembly 40 (such as the back wall of the plug assembly 40), all of the positioning tabs 24 may be removed. If however, the plug lead frame element 14, 16 or 18 is to be positioned such that it extends at an intermediate length ("second mating level"), a portion of the positioning tabs 24 (such as one positioning tab 24) may be removed. On the other hand, if the plug lead frame element 14, 16 or 18 is to be positioned such that it extends at a shortest length ("third mating level"), none of the positioning tabs 24 may be removed. Thus, varying the mating levels of the plug lead frame elements 14, 16 and 18 allows for a plurality of different lead frame sequences from one lead frame. Thus, various lead frame sequences may be achieved through the use of lead frame elements, such as plug lead frame elements 14, 16 and 18. As shown in FIG. 3, for example, the plug lead frame element 14 is at the third mating level, the lead frame element 16 is at the second mating level and the lead frame element 18 is at the first mating level. However, plug lead frame elements 14, 16 and 18 positioned behind the plug lead frame elements 14, 16 and 18 are positioned at different mating levels. As mentioned above, the plug lead frame elements 14, 16 and 18 may not include the positioning tabs 24. That is, the positioning tabs 24 are used to assist in properly positioning the plug lead frame elements 14, 16 and 18, but are not required for proper positioning.

FIGS. 4–7 illustrate exemplary plug lead frame sequences 62, 64, 66 and 68, according to an embodiment of the present invention. FIGS. 4–7 show the plug lead frames 14, 16 and 18 as each would be positioned within the plug assembly 40 (or other such plug assemblies). However, for clarity, the plug assembly 40 is not shown. It is noted that identical sets of plug lead frame elements 14, 16 and 18 are used to form each of the plug lead frame sequences 62, 64, 66 and 68.

Lead frame sequence 62 includes the first and second plug lead frame elements 14 and 16 at the third mating level ($L_3$) and the lead frame element 18 at the first mating level ($L_1$). Each mating level is measured from a reference point within the plug assembly 40, such as the back wall of the plug assembly, or from a terminal end of a positioning channel of a lead frame element organizer. Lead frame sequence 64 includes the plug lead frame element 14 at the third mating level ($L_3$), the lead frame element 16 at the second mating level ($L_2$), and the lead frame element 18 at the first mating level ($L_1$). Lead frame sequence 66 includes the plug lead frame elements 14, 16 and 18 at the second mating level ($L_2$). Lead frame sequence 68 includes the plug lead frame element 14 at the first mating level ($L_1$), while the plug lead frame elements 16 and 18 are at the third mating level ($L_3$). FIGS. 4–7 are examples, which by no mean limit the invention to the sequences 62, 64, 66 and 68 shown. That is, each plug lead frame element 14, 16 and 18 may be positioned at first, second or third mating levels. Further, the plug lead frame elements 14, 16 and 18 may be combined in twenty-seven different lead frame sequence combinations if three different plug lead frame elements 14, 16 and 18 are used. Thus, twenty-seven different lead frame sequences may be produced using three different lead frame elements. However, more or less than three different plug lead frame elements 14, 16 and 18 may be used with certain embodiments of the present invention. Thus, certain embodiments of the present invention may accommodate more or less than twenty-seven different lead frame sequence combinations.

Figure 8:
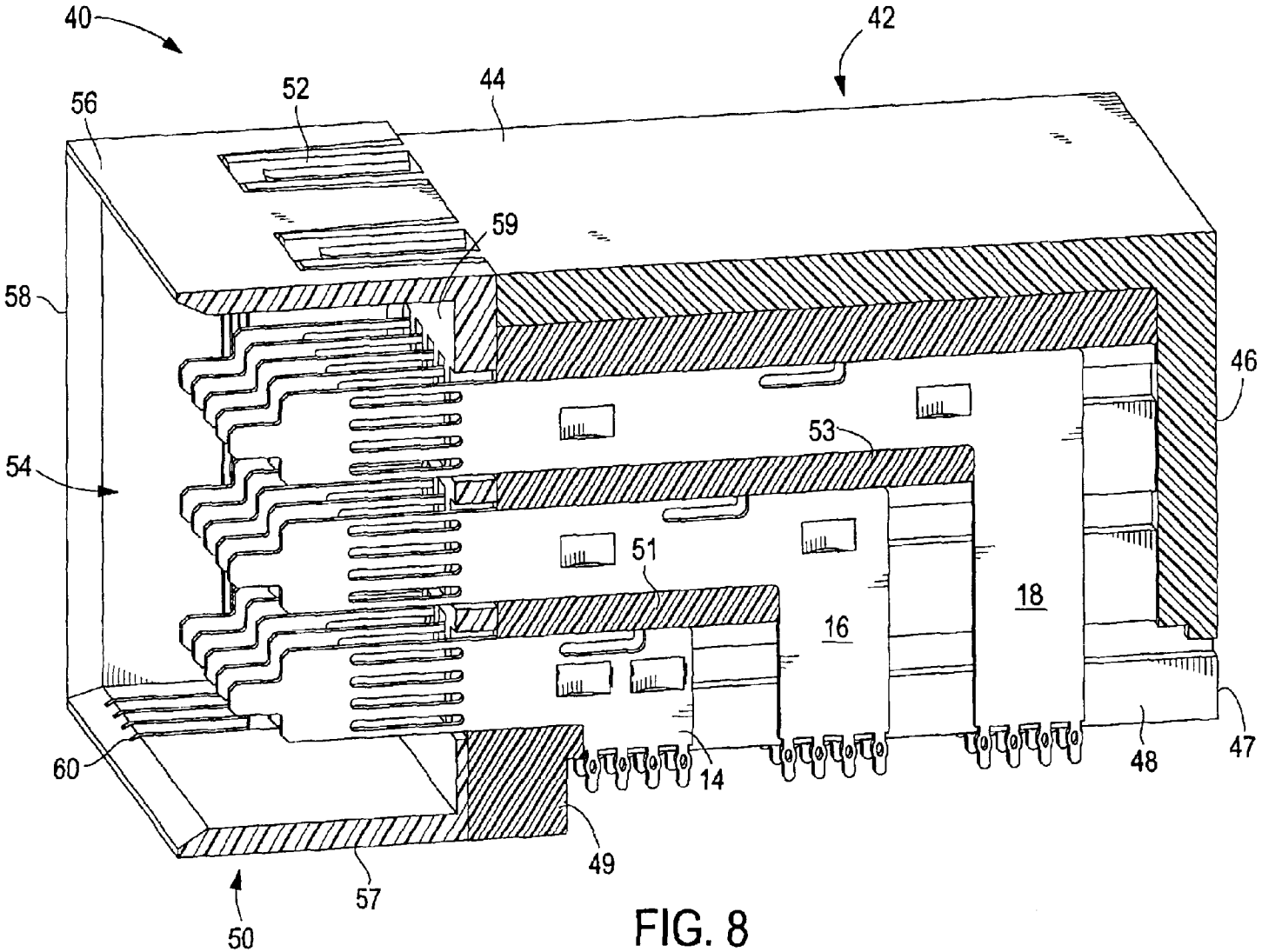
FIG. 8 is an isometric cross sectional view of the plug assembly including each plug lead frame element positioned at a first mating level, formed in accordance with an embodiment of the present invention.

FIG. 8 is an isometric cross sectional view of the plug assembly 40 including each plug lead frame element 14, 16 and 18 positioned at the first mating level, formed in accordance with an embodiment of the present invention. As shown in FIG. 8, the positioning tabs 24 of each plug lead frame element 14, 16 and 18 have been removed such that each plug lead frame element 14, 16 and 18 extends to its fullest extent into the cavity 54.

Figure 13:
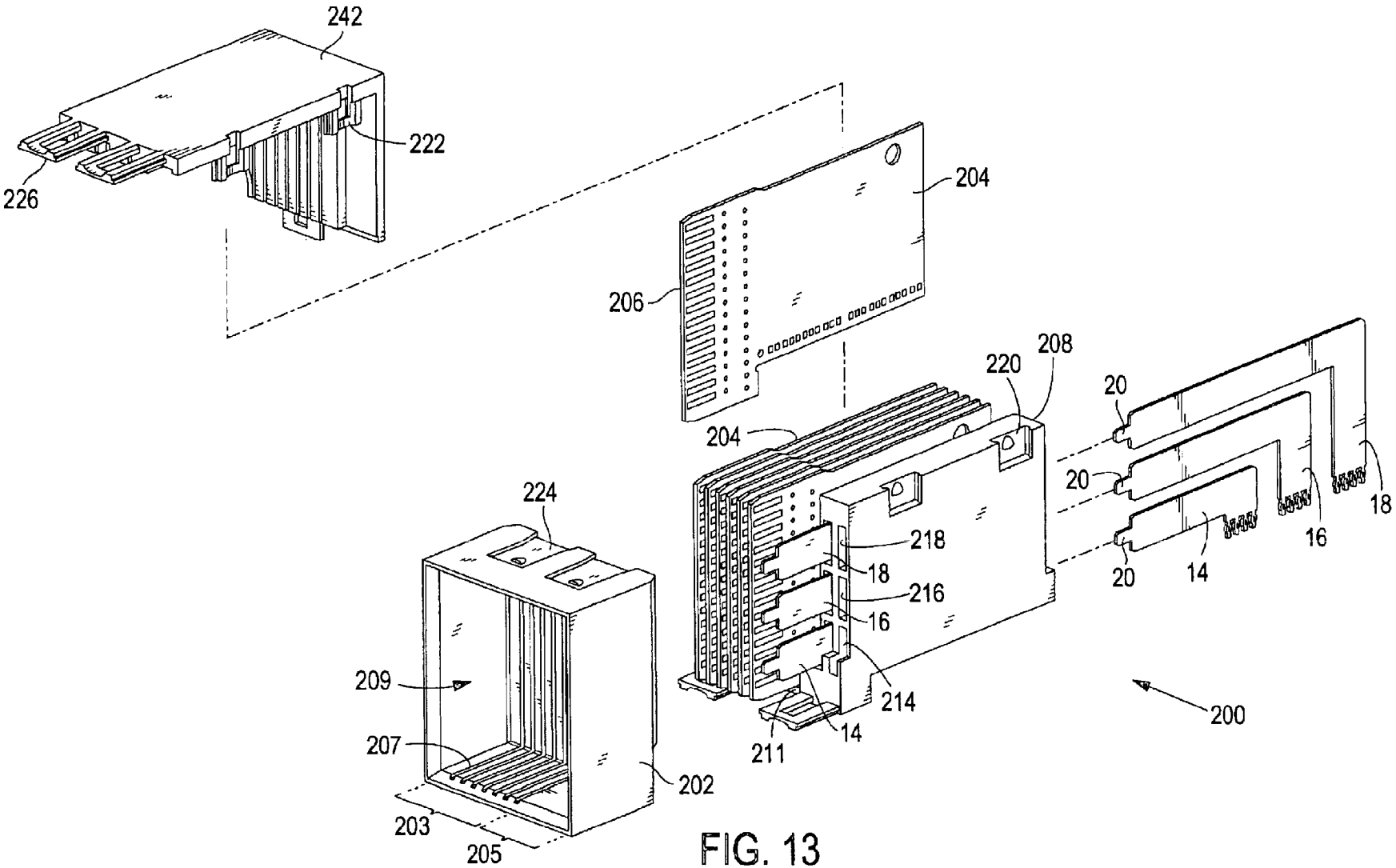
FIG. 13 is an isometric exploded view of a plug assembly according to an embodiment of the present invention.

FIG. 13 is an isometric exploded view of a plug assembly 40 according to an embodiment of the present invention. As mentioned above the plug assembly 40 may house electrical wafers (such as electrical wafer 204) and plug lead frame elements 14, 16 and 18 in a common housing, or in separate housings included within the plug assembly. Plug assembly 200 includes an interface housing 202, a plug lead frame housing 208, a wafer organizer 211 and a cover 242. The interface housing 202 includes a wafer section 203 having slots 207 (that receive and retain electrical wafers 204) and a lead frame section 205 within a cavity 209 formed by walls of the interface housing 202. The interface housing 202 also includes latch receptacles 224. The cover 242 includes latch members 226 that engage the latch receptacles 224 and latch members 222 that engage latch receptacles 220 of the lead frame housing 208. The lead frame housing 208 includes passages 214, 216 and passages 218. The plug lead frame element 14 is received and retained within the passage 214. The lead frame element 16 is received and retained within the passage 216. The lead frame element 18 is received and retained within the passage 218. It is to be noted that the lead frame housing 208 includes spacers (as discussed above) within the lead frame housing 208 for proper positioning of the plug lead frame elements 14, 16 and 18. The electrical wafers 204 are positioned within channels (not shown) of the wafer organizer 211. Upon assembly of the plug assembly 200, contact portions 20 of the plug lead frame elements 14, 16 and 18 extend outwardly from the back wall of the interface housing 202 into the cavity 209. Also, contact edges 206 of the electrical wafers 204 (and/or signal and ground terminals connected to the electrical wafers 204) likewise extend into the cavity 209 of the interface housing 202.

Figure 9:
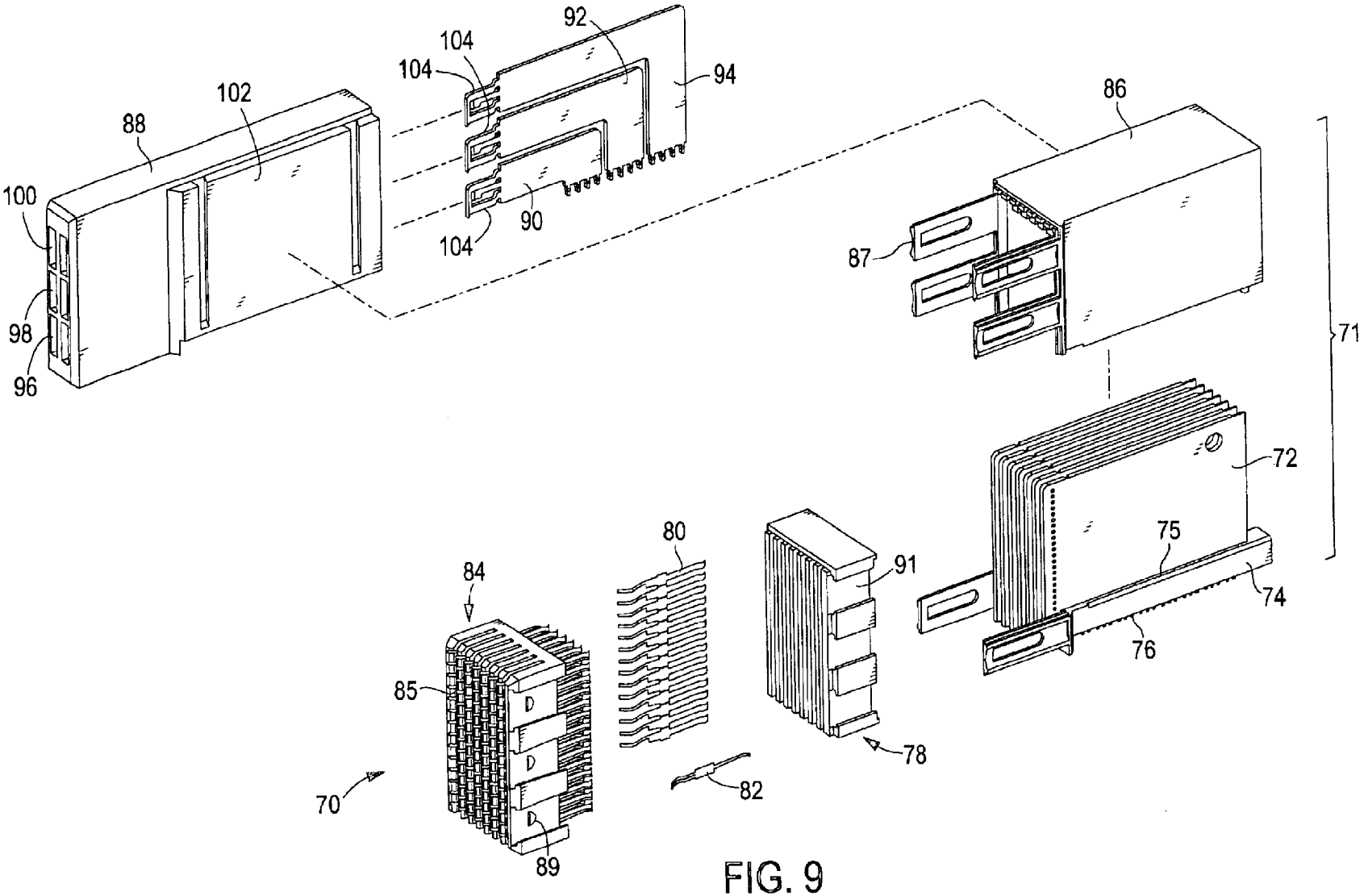
FIG. 9 is an isometric exploded view of a receptacle assembly formed in accordance with an embodiment of the present invention.

FIG. 9 is an isometric exploded view of a receptacle assembly 70 formed in accordance with an embodiment of the present invention. The receptacle assembly 70 includes a wafer housing 71 having a wafer organizer 74, an intermediate floating member 78, a plurality of signal and ground terminals 82 and 80 and a terminal interface housing 84. The organizer 74 includes channels 75, each of which receive and retain an electrical wafer 72. Each electrical wafer 72 is connected to contact pins 76 extending downwardly therefrom. Each electrical wafer 72 is connected to a row of ground terminals 80 or signal terminals 82, or a row of alternating ground and signal terminals 80 and 82. The signal and ground terminals 82 and 80 are retained within the intermediate floating member 78 and the terminal interface housing 84, which includes contact passages 85. The contact passages 85 allow contact portions of the signal and ground terminals 82 and 80 of the receptacle assembly 70 to mate with corresponding wafers housed within a compatible plug assembly. The housing 86 is positioned over the electrical wafers 72 and snapably engages the board organizer 74. The cover 86 also latchably engages the terminal interface housing 84 through the mating of the latch members 87 with the latch receptacles 89. Also, because the intermediate floating member 78 is positioned between the cover 86 and the terminal interface housing 84, the latch members 87 are also retained by the latch channels 91 of the intermediate floating member 78.

As shown in FIG. 9, the receptacle assembly 70 also includes a lead frame housing 88, which is separate and distinct from the wafer housing 71. In the embodiment shown in FIG. 9, lead frame housing 88 mounts to the wafer housing 71 through an interaction, or mating, of the mounting surface 102 with a corresponding mating surface on the wafer housing 71. Alternatively, however, the wafers 72 and lead frame elements may be housed within the same housing. The lead frame housing 88 includes a cavity 96 for a receptacle lead frame element 90, a cavity 98 for a receptacle lead frame element 92 and a cavity 100 for a receptacle lead frame element 94. Each set of receptacle lead frame elements, including, the receptacle lead frame elements 90, 92 and 94 is configured similarly to a set of plug lead frame elements, including the plug lead frame elements 14, 16 and 18 except that the contact portions 104 of the receptacle lead frame elements 90, 92 and 94 are configured to mate with the contact portions 20 of the plug lead frame elements 14, 16 and 18. The receptacle lead frame elements 90, 92 and 94 may be positioned at different mating levels in a similar fashion as that of the plug lead frame elements 14, 16 and 18.

Figure 10:
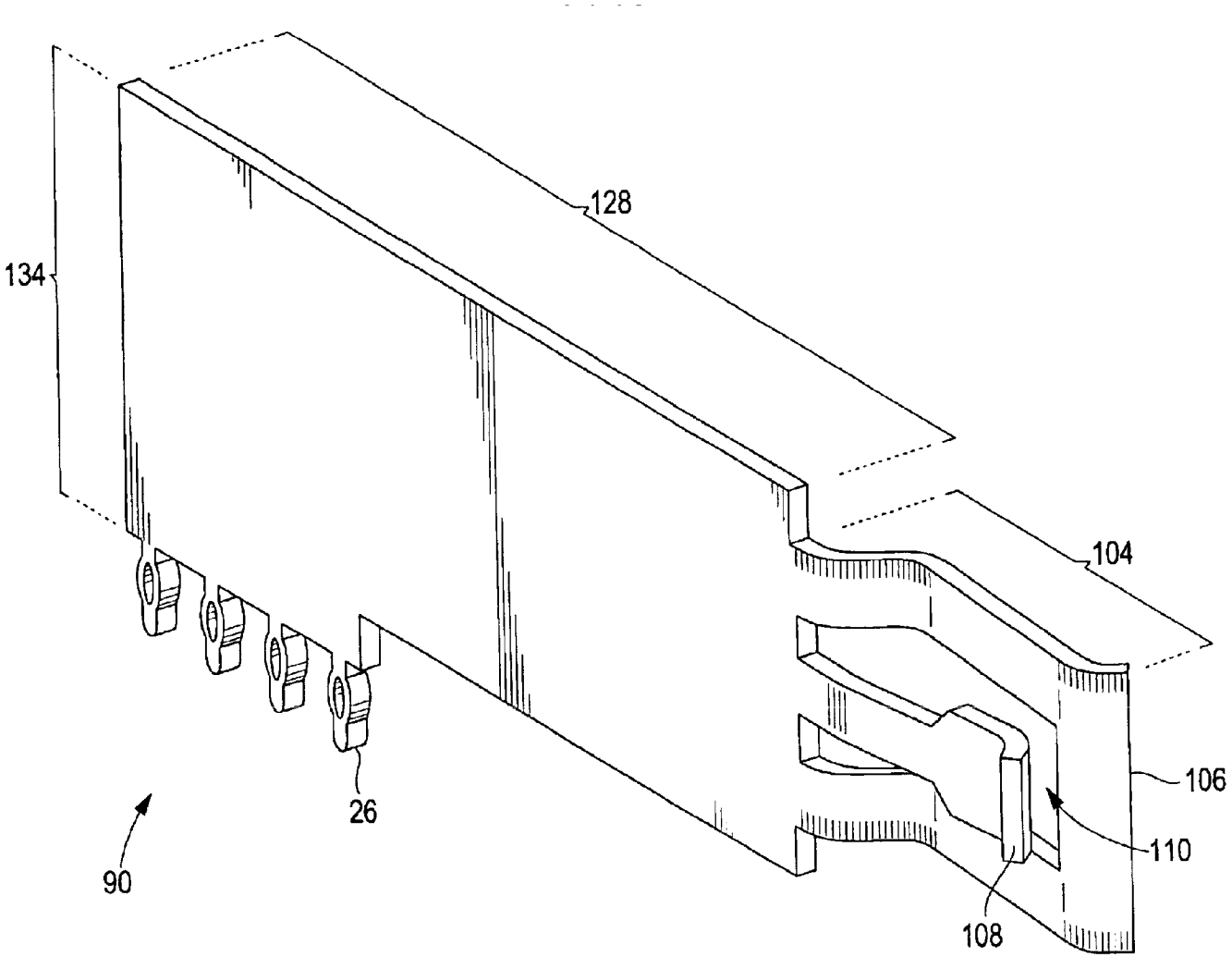
FIG. 10 is an isometric view of the first receptacle lead frame element according to an embodiment of the present invention.

FIG. 10 is an isometric view of the receptacle lead frame element 90 according to an embodiment of the present invention. The receptacle lead frame element 90 includes an extension portion 128 and a board transition portion 134. The contact portion 104 of the receptacle lead frame element 90 includes a first member 108 and a second member 106 extending outwardly from the first extension portion 128. A plug contact channel 110 is defined between the first member 108 and the second member 106. During mating, the contact portion 20 of the plug lead frame element 14 is positioned within the plug contact channel 110 between the members 108 and 106, such that the contact portion 20 is sandwiched between the members 108 and 106. The members 108 and 106 contact the contact portion 20 of the plug lead frame element 14 thereby establishing an electrical connection between the plug lead frame element 14 and the receptacle lead frame element 90.

The receptacle lead frame elements 92 and 94 are configured similar to the receptacle lead frame element 90. Further, the mating between the receptacle lead frame elements 92 and 94 and the plug lead frame elements 16 and 18 occurs in a similar fashion to that described above with respect to the receptacle lead frame element 90 and the plug lead frame element 14.

Referring again to FIG. 9, the receptacle assembly 70 may mate in a parallel, or in-line, fashion with the plug assembly 40. That is, a sequence of plug lead frame elements 14, 16 and 18 mate with a sequence of receptacle lead frame elements 90, 92 and 94. For example, a plug lead frame element 14 may mate with a receptacle lead frame element 90, a plug lead frame element 16 may mate with a receptacle lead frame element 92, while a plug lead frame element 18 may mate with a receptacle lead frame element 94. The receptacle lead frame elements 90, 92 and 94 may be positioned at the same mating level such that, during mating, certain plug lead frame elements 14, 16 or 18, which may be at varying mating levels, may contact the corresponding receptacle lead frame elements 90, 92 and 94 before other plug lead frame elements 14, 16 or 18 contact their corresponding receptacle lead frame elements 90, 92 and 94. For example, the plug lead frame element 14 may contact the receptacle lead frame element 90 before the plug lead frame elements 16 and 18 contact the receptacle lead frame elements 92 and 94, respectively.

Alternatively, the receptacle lead frame elements 90, 92 and 94 may be positioned at varying mating levels while the plug lead frame elements 14, 16 and 18 may all be positioned at the same mating level. Also, alternatively, the receptacle lead frame elements 90, 92 and 94 may be positioned at different mating levels, while the plug lead frame elements 14, 16 and 18 are also positioned at different mating levels.

For example, a plug lead frame element 14 may be positioned at a first mating level (while a lead frame element 16 may be positioned at a different mating level than that of the plug lead frame element 14), while a corresponding receptacle lead frame element 90 may be positioned at a first mating level, second mating level or third mating level (while the second receptacle lead frame element 92 is positioned at a different mating level than that of the receptacle lead frame element 90). Overall, certain plug lead frame elements 14, 16 or 18 may contact certain receptacle lead frame elements 90, 92 and 94 at different times during mating. For example, it may be desired to have a ground lead frame 14, 16 or 18 contact a corresponding ground receptacle lead frame 90, 92 or 94 before signal lead frames contact each other. Because of the multi-sequence nature of the plug lead frame elements 14, 16 and 18 and the receptacle lead frame elements 90, 92 and 94, a variety of different mating sequences may be used such that certain plug lead frame elements 14, 16 or 18 contact certain receptacle lead frame elements 90, 92 or 94, respectively, before others.

Figure 11:
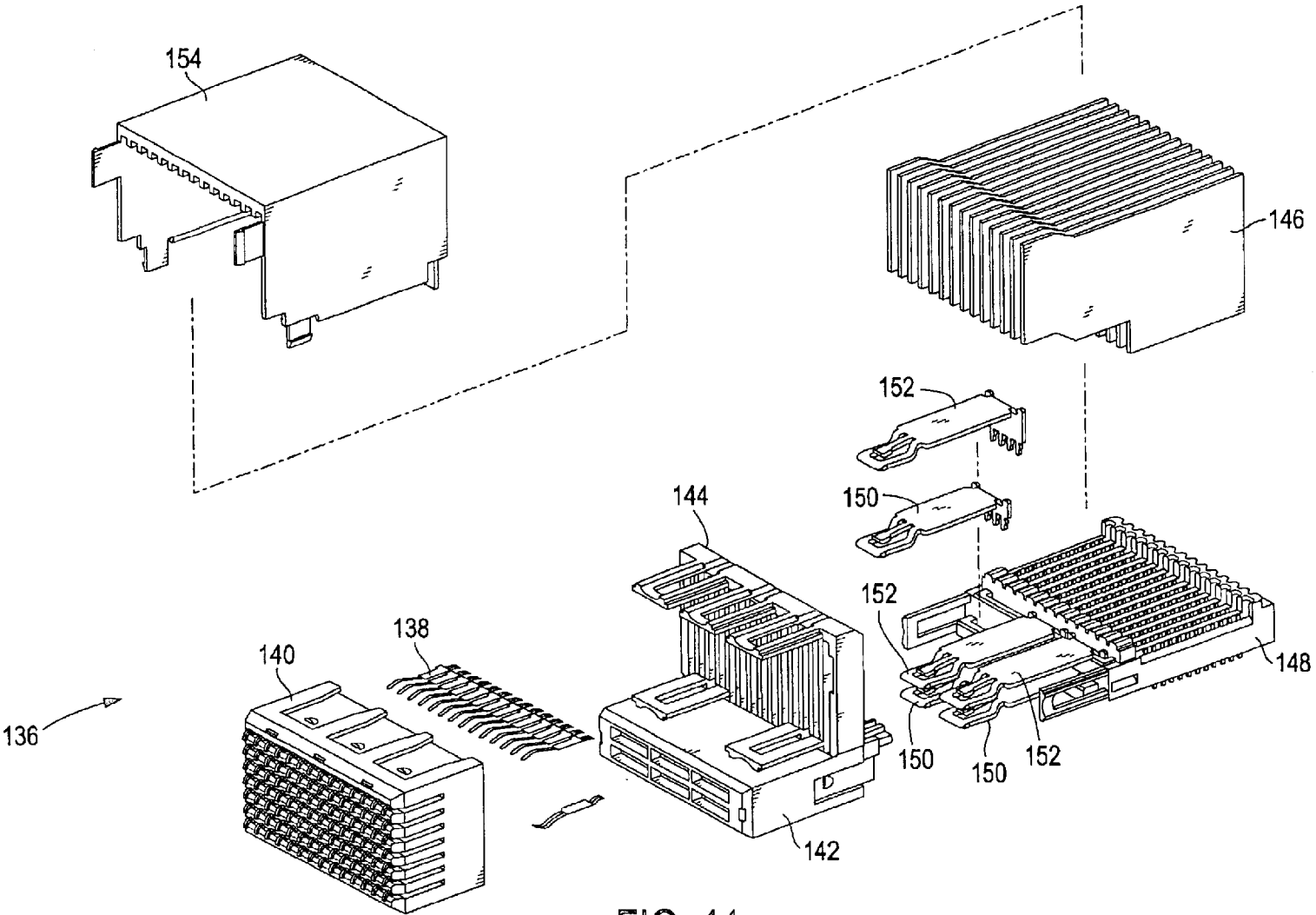
FIG. 11 is an isometric exploded view of a receptacle assembly formed in accordance with an embodiment of the present invention.

FIG. 11 is an isometric exploded view of a receptacle assembly 136 formed in accordance with an embodiment of the present invention. The receptacle assembly 136 differs from the receptacle assembly 70 in that the receptacle assembly 136 aligns ground and signal terminals 138 in rows (as opposed to the column configuration shown with respect to the receptacle assembly 70). The receptacle assembly 70 and the receptacle assembly 136 may mate with a plug assembly in an orthogonal or in-line manner, depending on the orientation of the terminals and plug lead frame elements of the compatible plug assembly.

The receptacle assembly 136 includes terminals 138, a terminal interface housing 140, an intermediate member 144 mounted over a lead frame housing 142, a cover 154 and an organizer 148 for receiving and retaining electrical wafers 146 and receptacle lead frame elements 150 and 152. The receptacle lead frame elements 150 and 152 are positioned in two rows. That is, a receptacle lead frame element 150 is positioned below a receptacle lead frame element 152. A planar row of lead frame elements 150 is formed and a planar row of lead frame elements 152 is formed upon assembly of the receptacle assembly 136. The receptacle assembly 136 may mate in an orthogonal fashion with the plug assembly 40. That is, a sequence of plug lead frame elements 14, 16 and 18 mate with a sequence of three receptacle lead frame elements 150 or 152.

For example, a plug lead frame element 14 may mate with a receptacle lead frame element 150, a lead frame element 16 may mate with another receptacle lead frame element 150, while a lead frame element 18 may mate with another lead frame element 150. The receptacle lead frame elements 150 and 152 may be positioned at the same mating level such that, during mating, certain plug lead frame elements 14, 16 or 18, which may be at varying mating levels, may contact the receptacle lead frame elements 150 and 152 before other plug lead frame elements 14, 16 or 18 contact the receptacle lead frame elements 150 and 152. Alternatively, the receptacle lead frame elements 150 and 152 may be positioned at varying mating levels while the plug lead frame elements 14, 16 and 18 may all be positioned at the same mating level. Overall, certain plug lead frame elements 14, 16 or 18 may contact certain receptacle lead frame elements 150 or 152 at different times during mating. For example, it may be desired to have a ground lead frame 14, 16 or 18 contact a corresponding ground receptacle lead frame 150 or 152 before signal lead frames contact each other.

Figure 12:
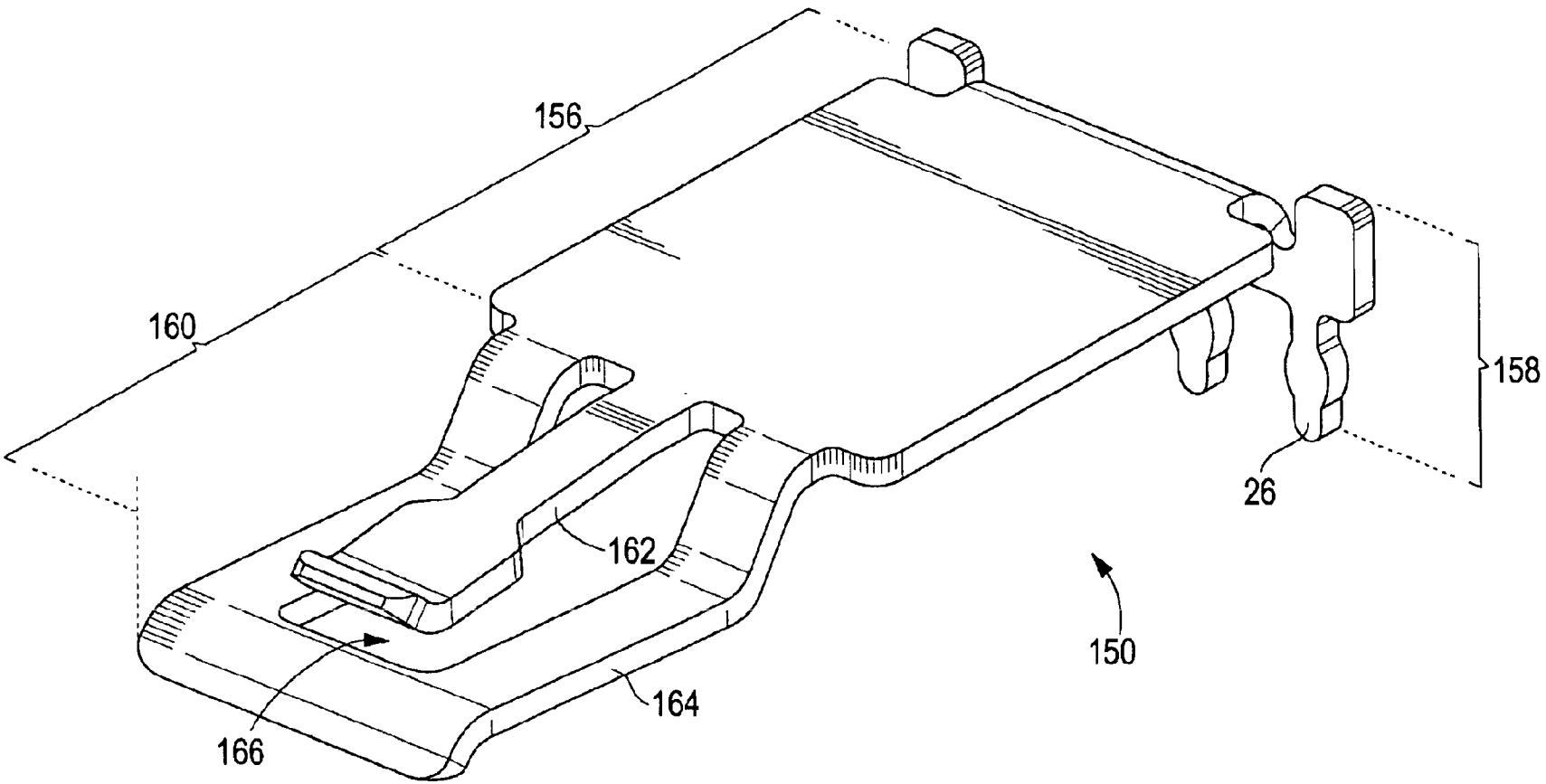
FIG. 12 is an isometric view of the first receptacle lead frame element according to an embodiment of the present invention.

FIG. 12 is an isometric view of the receptacle lead frame element 150 according to an embodiment of the present invention. The receptacle lead frame element 150 includes an extension portion 156 and a board transition portion 158. The contact portion 160 of the receptacle lead frame element 150 includes a member 162 and a member 164 extending outwardly from the extension portion 156. A plug contact channel 166 is defined between the member 162 and the member 164. During mating, the contact portion 20 of a plug lead frame element 14, 16 or 18 is positioned within the plug contact channel 166 between the members 162 and 164, such that the contact portion 20 is sandwiched between the members 162 and 164. The members 162 and 164 contact the contact portion 20 thereby establishing an electrical connection between the plug lead frame element 14, 16 or 18 and the receptacle lead frame element 150.

The receptacle lead frame element 152 is configured similar to the receptacle lead frame element 150. Further, the mating between the receptacle lead frame elements 152 and the plug lead frame elements 14, 16 or 18 occurs in a similar fashion to that described above with respect to the receptacle lead frame element 150.

Figure 14:
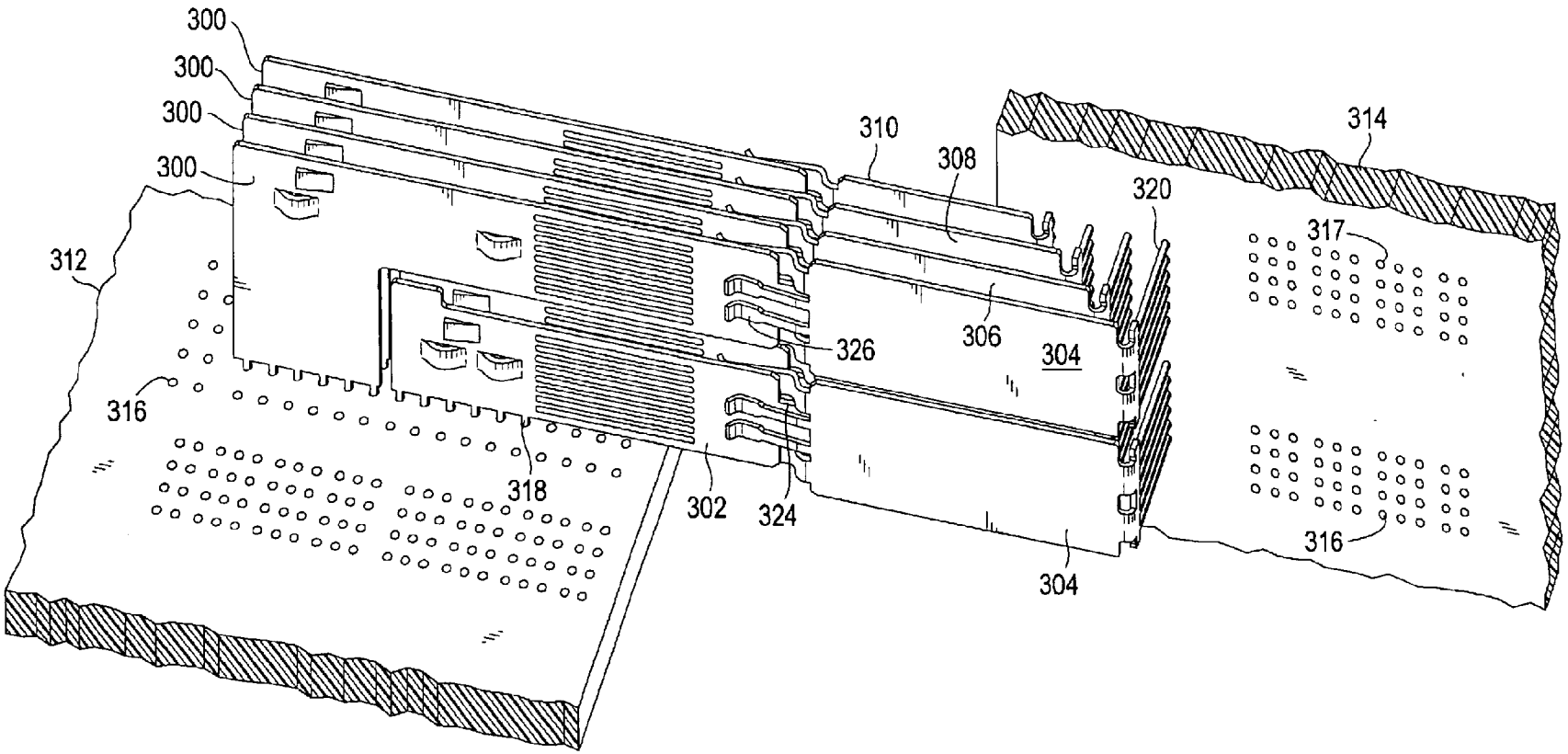
FIG. 14 is an isometric view of plug lead frame elements orthogonally mated with receptacle lead frame elements according to an embodiment of the present invention.

FIG. 14 is an isometric view of plug lead frame elements 300 and 302 orthogonally mated with receptacle lead frame elements 304, 306, 308, and 310 according to an embodiment of the present invention. The plug lead frame elements 300 and 302 include pins 318 that are received and retained by receptacles 316 formed within a printed circuit board 312. Similarly, the receptacle lead frame elements 304, 306, 308 and 310 include pins 320 that are received and retained by receptacles 317 formed within a printed circuit board 314. Each plug lead frame element 300 and 302 includes a contact portion 324 similar to the contact portions 20 (discussed above). However, as shown in FIG. 14, the receptacle lead frame elements 304, 306, 308 and 310 include a contact portion 326 that includes two members on a first side of the contact portion 324 of the plug lead frame elements 300 and 302 and at least one member on the other side of the contact portion 324.

One sequence of plug lead frame elements 300 and 302 mate with a sequence of two receptacle lead frame elements 304. A second sequence of plug lead frame elements 300 and 302 mate with two receptacle lead frame elements 306. Similarly, a third sequence of plug lead frame elements 300 and 302 mate with two receptacle lead frame elements 306. Also, a fourth sequence of plug lead frame elements 300 and 302 mate with two receptacle lead frame elements 308.

Figure 15:
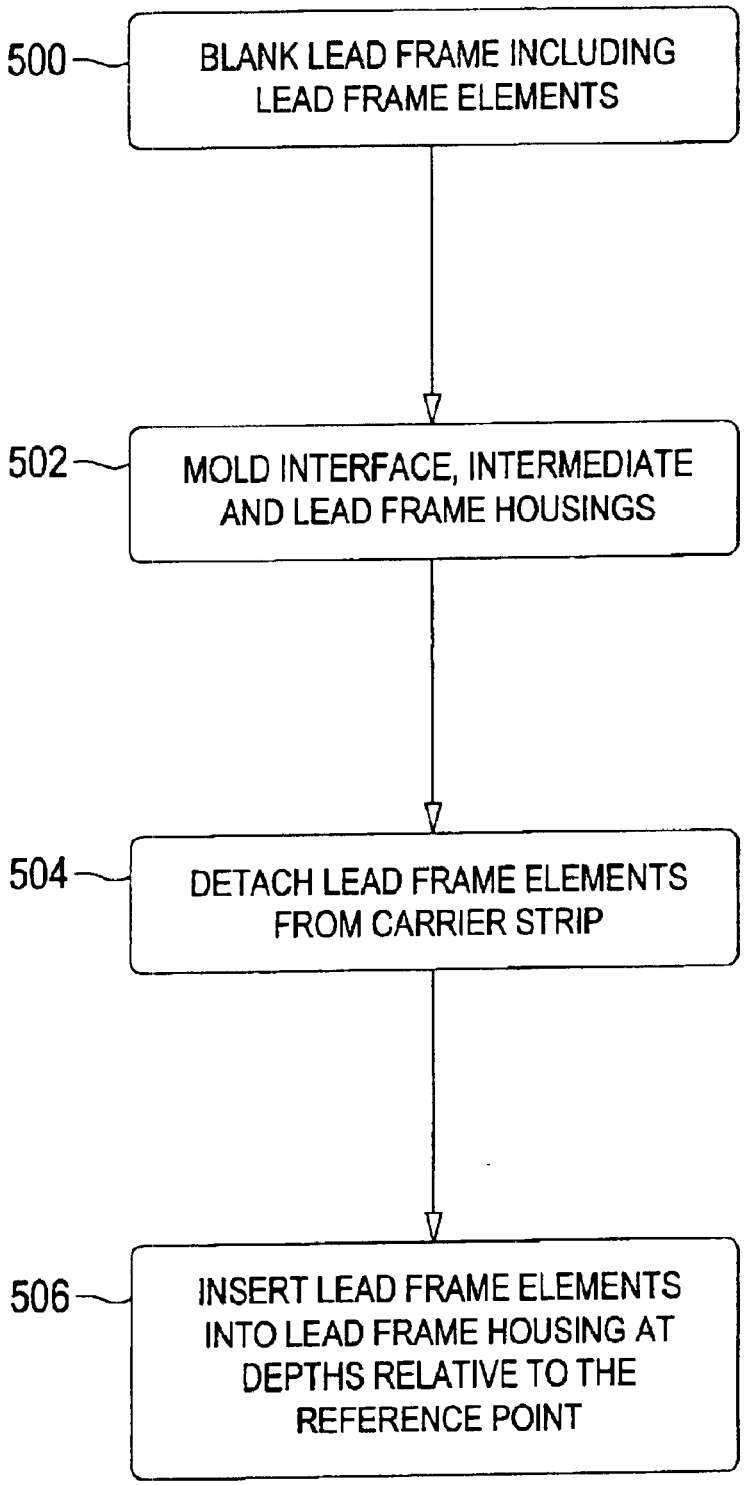
FIG. 15 is a flow chart of a method of manufacturing an electrical connector according to an embodiment of the present invention.

FIG. 15 is a flow chart of a method of manufacturing an electrical connector according to an embodiment of the present invention. At step 500, lead frames (including plug and receptacle lead frame elements) are stamped, blanked or otherwise formed. At step 502, the plug and receptacle interface, intermediate and lead frame housing are molded. At step 504, lead frame elements are separated from the carrier strip. At step 506, lead frame elements are inserted into the lead frame housings at varying depths relative to a reference point, thereby creating a plurality of mating levels.

Thus, embodiments of the present invention provide an efficient, interchangeable and adaptable lead frame through the use of a plurality of lead frame elements. That is, a small number of lead frame elements may be used to form a wide variety of lead frames through various combinations of the lead frame elements. Additionally, embodiments of the present invention provide a more efficient method of manufacturing various lead frame sequences. Embodiments of the present invention also provide a more efficient method of manufacturing connectors with various lead frame element sequences where a single lead frame may be used to form a plurality of mating levels. The mating levels are created by varying the depth of insertion of the lead frame elements. Any lead frame element may form any mating level and unique lead frame elements are not required for each mating level. It is to be understood that the lead frame elements may be used with electrical connectors that utilize lead frames. That is, the lead frame elements may be used with orthogonal or in-line connectors.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

a plug assembly; and a receptacle assembly, at least one of said plug and receptacle assemblies including first and second lead frame elements located in a lead frame plane, at least one of said first and second lead frame elements being positioned at one of a plurality of mating levels along a mating direction within said lead frame plane;

wherein each of said first and second lead frame elements initially includes at least one positioning tab, said at least one positioning tab being removed to position its corresponding said lead frame element at a first said mating level, and said at least one positioning tab remaining on its corresponding said lead frame element to position its corresponding said lead frame element and a second said mating level.

2. The electrical connector assembly of claim 1 wherein said plurality of mating levels define different distances between a contact portion of said first lead frame element and a reference point within said at least one of said plug and receptacle assemblies.

3. The electrical connector assembly of claim 1 wherein said first lead frame element is positionable at any one of shallow, intermediate and deep said mating levels with respect to a mating face of said at least one of said plug and receptacle assemblies.

4. The electrical connector assembly of claim 1 further including a third lead frame element located in said lead frame plane, said third lead frame element being positioned at one of said plurality of mating levels along said mating direction.

5. The electrical connector assembly of claim 1 wherein a first plug lead frame element of said plug assembly contacts a first receptacle lead frame element of said receptacle assembly before a second plug lead frame element of said plug assembly contacts a second receptacle lead frame element of said receptacle assembly when said plug assembly and said receptacle assembly are mated together.

6. The electrical connector assembly of claim 1 wherein said plug assembly orthogonally mates with said receptacle assembly.

7. The electrical connector assembly of claim 1 wherein said plug assembly mates in an in-line fashion with said receptacle assembly.

8. An electrical connector comprising:

a housing having an interior chamber defining a lead frame plane; and lead frame elements mounted in said interior chamber and aligned within said lead frame plane, each of said lead frame elements being positionable at any one at multiple mating levels along a mating direction of said electrical connector.

9. The electrical connector of claim 8 where N said lead frame elements are each positionable at M said mating levels to form X lead frame element configurations within the housing, wherein $X=M^N$.

10. The electrical connector of claim 8 wherein said electrical connector is an orthogonal electrical connector.

11. The electrical connector of claim 8 wherein said electrical connector is a parallel edge-mating connector.

12. The electrical connector of claim 8 further comprising a plurality of electrical wafers.

13. The electrical connector of claim 8 wherein each of said lead frame elements initially includes at least one positioning tab, said at least one positioning tab being removed to position its corresponding said lead frame element at a first said mating level; said at least one positioning tab remaining on its corresponding said lead frame element to position its corresponding said lead frame element at a second said mating level.

14. An electrical connector comprising:

a housing that holds identical sets of leads frame elements, said housing defining mating levels along a mating direction of said electrical connector, and each of said identical sets including at least two of said lead frame elements each of which is positionable at any one of said mating levels.

15. The electrical connector of claim 14 wherein each of said identical sets includes N said lead frame elements, each of which is positionable at M said mating levels to form X lead frame element configurations within the housing, wherein $X=M^N$.

16. The electrical connector system of claim 14 wherein each of said at least two lead frame elements initially include at least one positioning tab, said at least one positioning tab being removed to position its corresponding said lead frame element at a first said mating level, said at least one positioning tab remaining on its corresponding said lead frame element to position its corresponding lead frame element at a second said mating level.

17. The electrical connector of claim 14 wherein each of said identical sets of lead frame elements is formed as a lead frame.

18. The electrical connector of claim 14 wherein each of said at least two lead frame elements includes multiple positioning tabs which are selectively removable to position each of said at least two lead frame elements at a selected one of said mating levels.

* * * * *

UNITED STATES PATENT AND TRADEMARK OFFICE

CERTIFICATE OF CORRECTION

PATENT NO. : 6,890,214 B2 
DATED : May 10, 2005
INVENTOR(S) : John B. Brown and Steven A. Weller It is certified that error appears in the above-identified patent and that said Letters Patent is hereby corrected as shown below:

Column 11,
Line 48, change "at any one at" to -- at any one of --.

Signed and Sealed this

Second Day of August, 2005

JON W. DUDAS
*Director of the United States Patent and Trademark Office*